US006183325B1

(12) United States Patent
Purser

(10) Patent No.: US 6,183,325 B1
(45) Date of Patent: Feb. 6, 2001

(54) OARLOCK HEIGHT ADJUSTER FOR A ROWING OR SCULLING SHELL

(76) Inventor: William Ray Purser, 5688 Antiqua Blvd., San Diego, CA (US) 92124-1306

( * ) Notice: Under 35 U.S.C. 154(b), the term of this patent shall be extended for 0 days.

(21) Appl. No.: 09/329,630

(22) Filed: Jun. 10, 1999

(51) Int. Cl.[7] ..... B63H 16/06
(52) U.S. Cl. ..... 440/106; 440/104; 440/105
(58) Field of Search ..... 440/101, 105, 440/106, 104, 107, 108, 109

(56) References Cited

U.S. PATENT DOCUMENTS 468,960 * 2/1892 Vonersaar ..... 440/109
700,827 * 5/1902 Rollins ..... 440/105
1,223,512 * 4/1917 Neville ..... 440/105
4,411,214 10/1983 Horiuchi .
5,873,757 2/1999 Van Balen .
5,881,979 * 3/1999 Rozier et al. ..... 248/188.5

* cited by examiner

*Primary Examiner*—Stephen Avila

(57) ABSTRACT

An oarlock (26) for a rowing shell (42) is threaded onto an adjusting tube (10) longer than the oarlock and just shorter than an oarlock pin (16). This oarlock/tube assembly is slipped over the pin and secured so that it is free to pivot. The pin is attached to a sill (28) of a rigger (32). Manual turning of the tube will raise or lower the oarlock without disassembly to make adjustment for height and weight of rowers or changing water conditions.

3 Claims, 6 Drawing Sheets

FIG. 8a
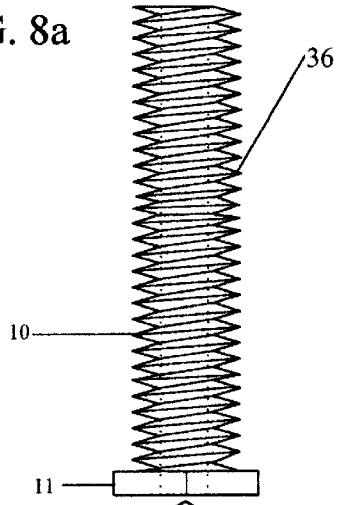
FIG. 8b
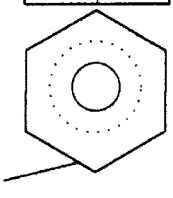
FIG. 10a
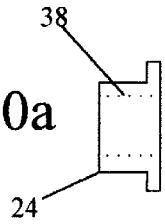
FIG. 10b
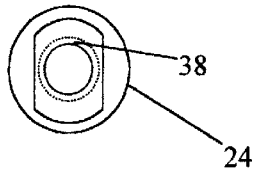
FIG. 10c
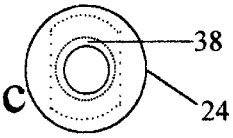
FIG. 11a
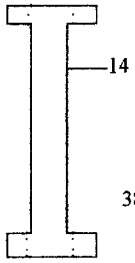
FIG. 11b
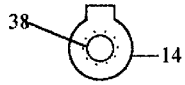
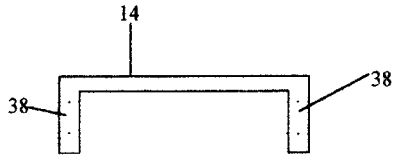
FIG. 11c
FIG. 9a
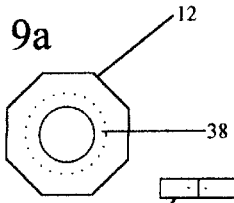
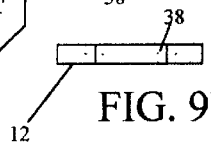
FIG. 9b

OARLOCK HEIGHT ADJUSTER FOR A ROWING OR SCULLING SHELL

BACKGROUND—FIELD OF INVENTION

This invention relates to rowing or sculling shell rigging, specifically to an oarlock height adjusting tube that provides for manual adjustment of oarlock height for proper fit of the oar to rower and rowing conditions.

BACKGROUND—DESCRIPTION OF PRIOR ART

Rowing shells, both sweep rowing boats and sculling boats, are moved through the water by oars. The oars transmit power from the rower to move the boat. Both recreational and racing shells are very narrow in beam and it is conventional to mount the oarlocks, which support the oars, outboard of the boat on laterally extending riggers. The comfort, efficiency, and safety of the rower depend upon proper geometry between the rower, boat, and water. This is greatly dependent on oarlock placement. Most rigging adjustments (oarlock span, spread, and pitch) are set and stay constant for all rowers in a particular boat. Oarlock height, however, is very variable, depending on the weight of the rower(s), the height of each rower, and water conditions. Adjusting the oarlock height on most shells is relatively complex, involving the use of tools to partially disassemble the rigging and/or the oarlock/pin assembly to add and remove spacers or to raise or lower the pin. See U.S. Pat. No. 4,411,214 Horiuchi as an example of prior art oarlock adjustment using spacers.

Prior art oarlock height adjustment methods typically have one or more of the following disadvantages.

In prior art practices, it is necessary to adjust the oarlock height before the shell is placed on the water. The position of the pin (out over the water) and the instability of the narrow rowing shell make it very difficult or even impossible for the rower to make adjustments while afloat. If a coach is handy in a launch, the coach can make adjustments, but there is always the risk of damage to the rowing shell as the two boats pitch and roll in close proximity. In addition, dropped tools or parts are usually not recoverable. As a result, this can be a very difficult and time consuming activity.

Currently, most riggers are made of aluminum while the fasteners are made of stainless steel. Repeated disassembly and reassembly cause premature wear on these aluminum components, especially to the topstays, leading to costly replacement.

If a rower has not rowed a particular rowing shell before or has not rowed with the same rowers in the same positions in a familiar rowing shell, oarlock height adjustment most likely will not be accurately predicted, before the shell is in the water with all rowers aboard.

If the same crew of rowers uses the same boat regularly, but share the shell with other crews, they most likely will have to take time to change the oarlock heights before they launch. Crews must also adjust oar height for anticipated weather and water conditions. This results in valuable practice time lost.

Some rowing shells adjust oarlock height by screwing the oarlock pin up or down in the sill after loosening a locknut and the topstay. After oarlock height adjustment, the topstay length must be readjusted for it to fit properly.

A well known shell manufacturer has attempted to solve these problems by using slotted spacers on the oarlock pin, above and below the oarlock. Spacers can be pulled and replaced without the use of tools, but this can be tricky with wet spacers, cold fingers, and choppy water, especially when raising oar height. The spacers sink, so removal and replacement over the water is risky; rowing without spacers is ill-advised.

A recent attempt to solve the problem of oar height adjustment, U.S. Pat. No. 5,873,757 Van Balen, makes use of an internal adjuster in the pin. It can be operated with one hand and has no loose parts. Even solid oarlock pins, however, are notorious for breaking off unexpectedly. Because of the complexity of its design and manufacture, it is difficult to envision a hollow three-part pin that is durable, reliable, and available at a price that would make it attractive.

Objects and Advantages

Accordingly, several objects and advantages of my invention are:

a) oarlock height adjustment using no tools and involving no loose parts; nothing to drop or lose.

b) oarlock height adjustment on or off the water quickly and easily.

c) oarlock height adjustment with no wear on rigger components.

d) oarlock height adjustment without changing other rigger adjustments.

e) an oarlock height adjusting device compatible with the current best-selling oarlock pins and gated oarlocks.

f) an oarlock height adjusting device with fewer parts than any other prior art method.

g) an oarlock height adjusting device of simple, rugged design.

h) an oarlock height adjusting device that is simple and rapid in its operation.

These and other objects and advantages will be made clear by the following description and drawings.

DRAWING FIGURES

In the drawings, closely related figures have the same number but different alphabetic suffixes.

Figure 1:
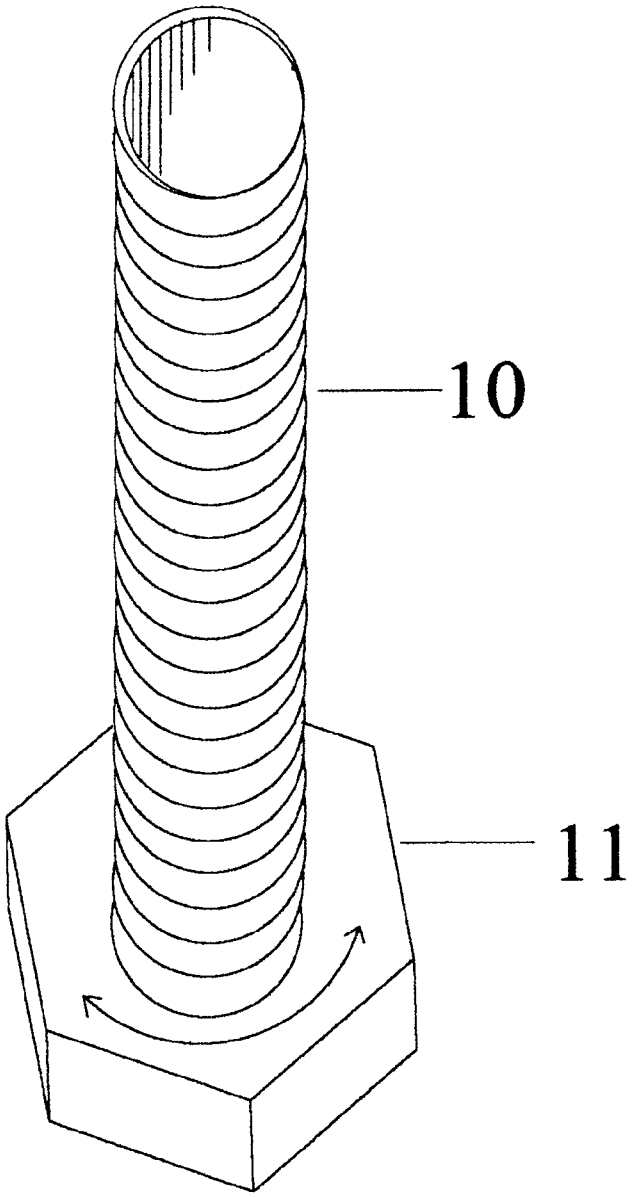
FIG. 1 shows an isometric view of an oarlock height adjusting tube.
Figure 2:
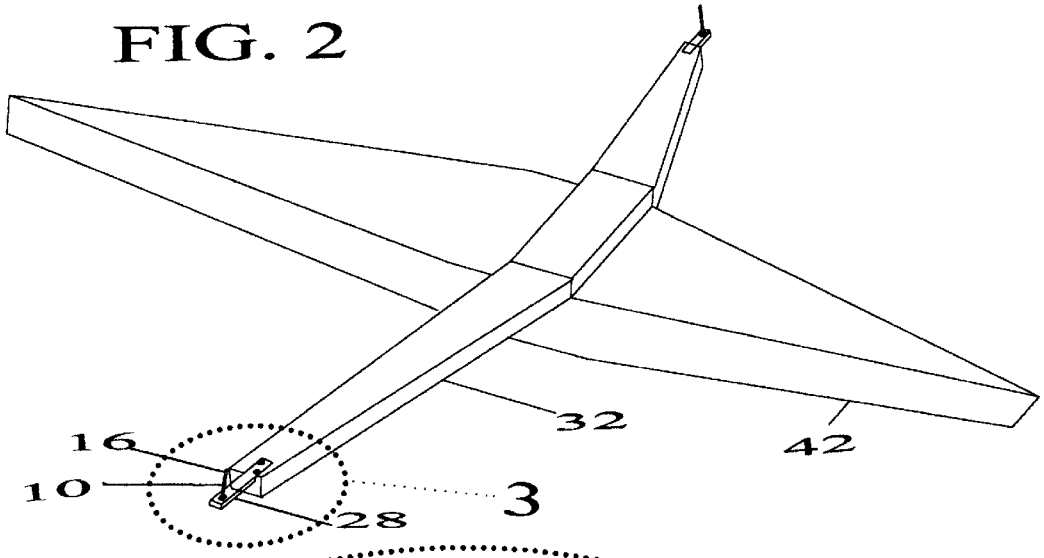
FIG. 2 shows the oarlock adjusting tube mounted on a rowing shell.
Figure 3:
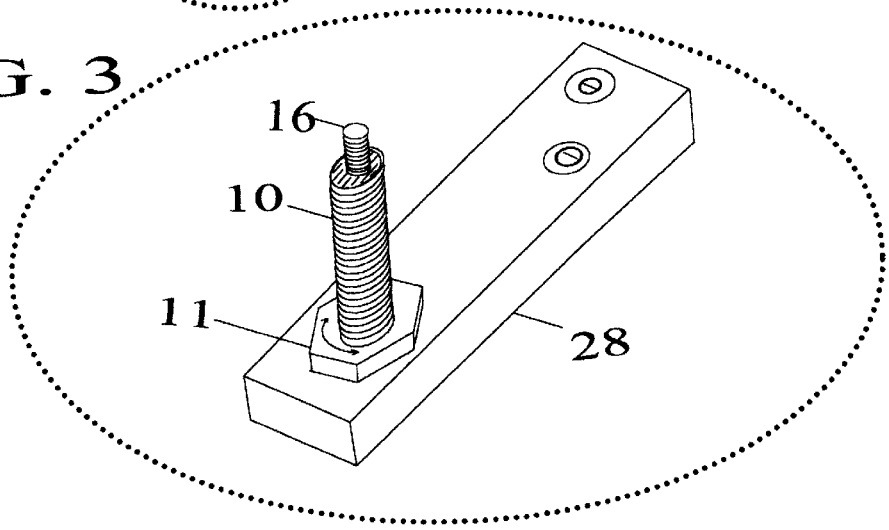
FIG. 3 shows a detail of FIG. 2.
Figure 4:
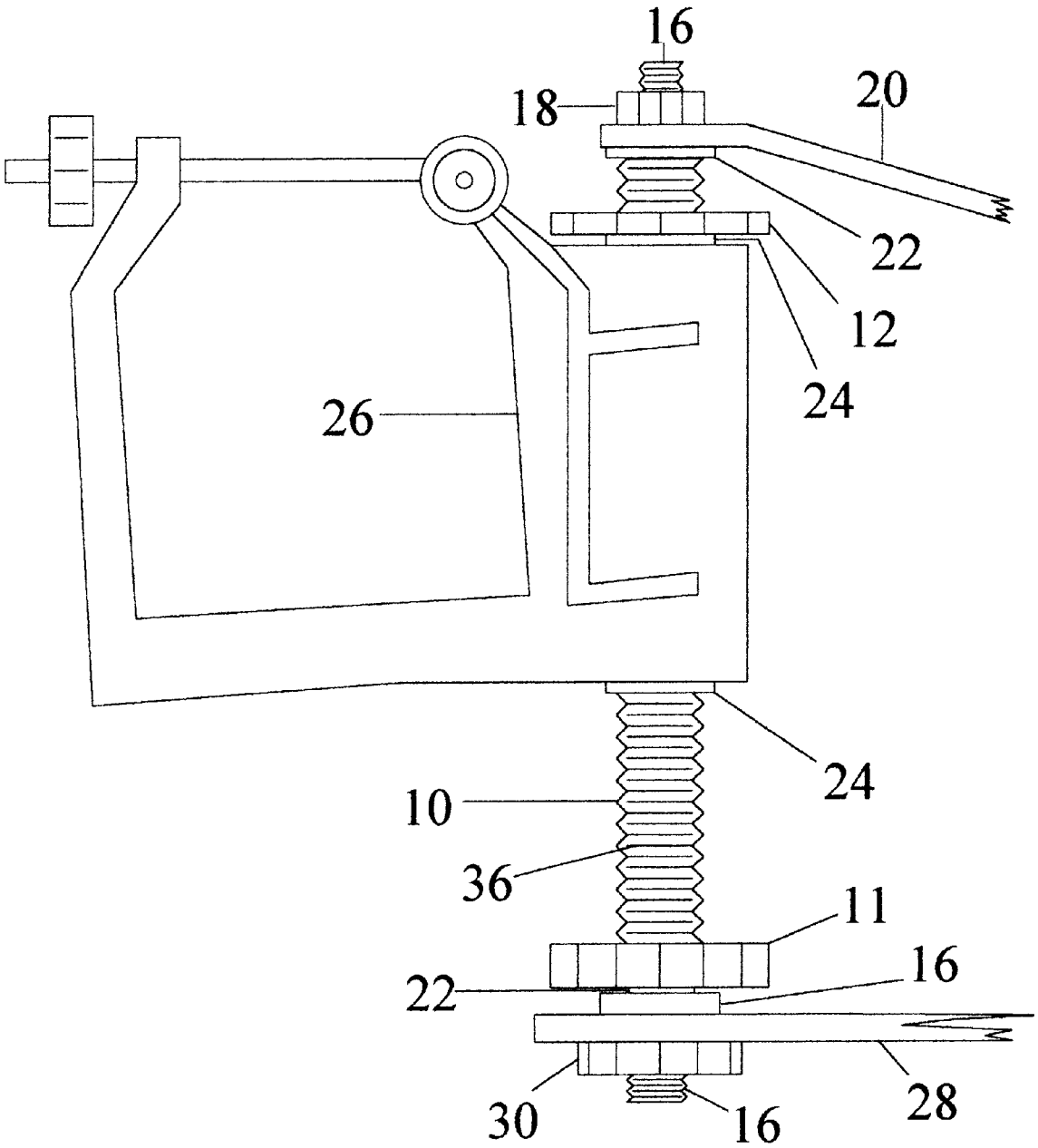
FIG. 4 shows a complete oarlock height adjuster assembly with oarlock and pin mounted on the shell rigger sill.
Figure 5:
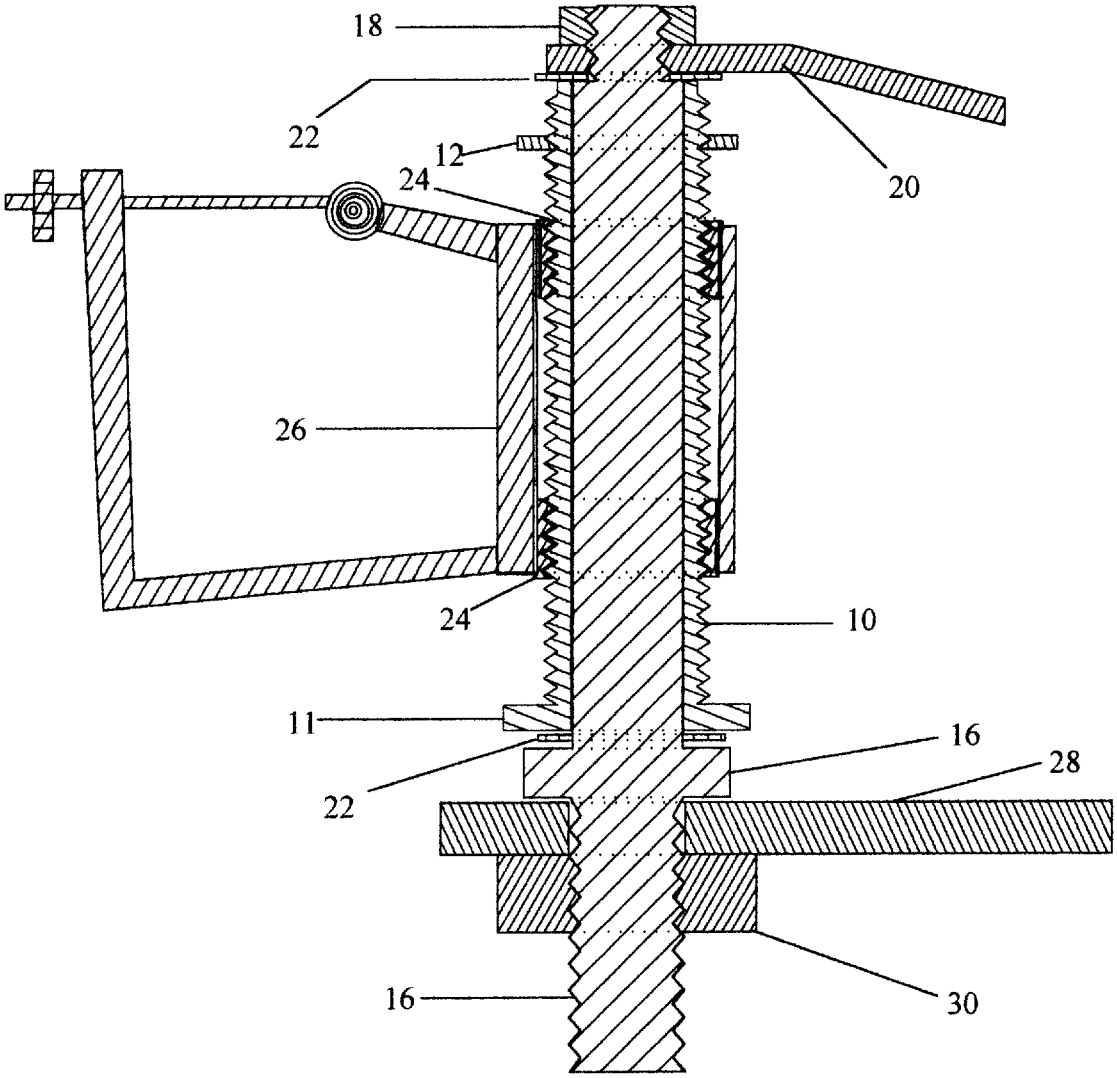
FIG. 5 shows a cross-section of FIG. 4.
Figure 6:
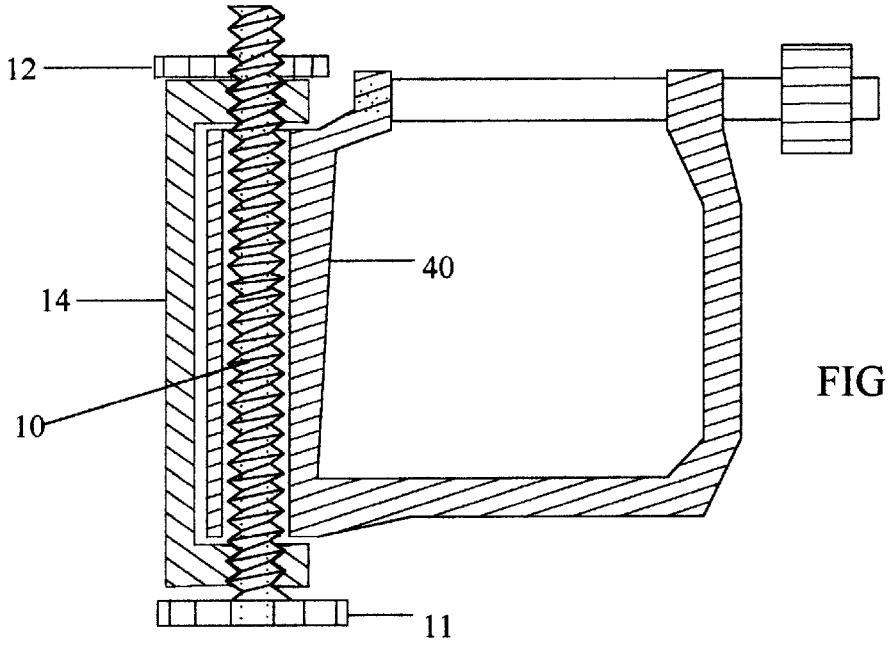
FIG. 6 shows a cross-section of the oarlock securing bracket being used to position an oarlock on the oarlock adjusting tube.
Figure 7:
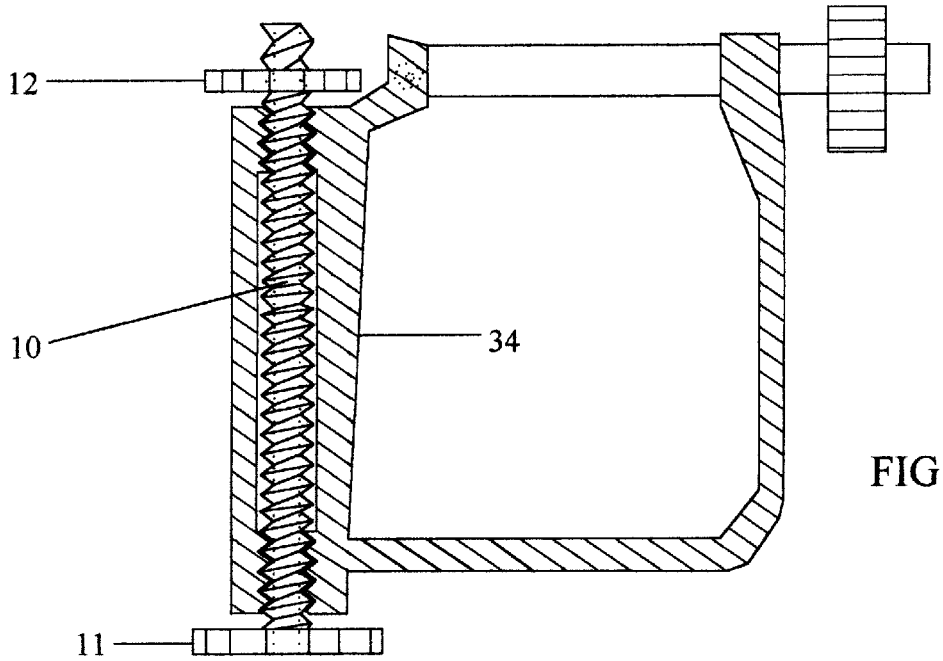
FIG. 7 shows a cross-section of a threaded oarlock mounted on the oarlock adjusting tube.

FIGS. 8*a* and 8*b* show aspects of the oarlock adjusting tube.

FIGS. 9*a* and 9*b* show aspects of the tube locknut.

FIGS. 10*a* to 10*c* show aspects of the oarlock inserts.

FIGS. 11*a* to 11*c* show aspects of the oarlock securing bracket.

| Reference Numerals in Drawings | |
|---|---|
| 10 adjusting tube | 11 flange |
| 12 tube locknut | 14 oarlock securing bracket |
| 16 oarlock pin | 18 pin top nut |
| 20 topstay | 22 washer |
| 24 oarlock insert | 26 oarlock |
| 28 sill | 30 pin bottom nut |
| 32 rigger | 34 threaded oarlock |
| 36 threads | 38 threaded hole |
| 40 unthreaded oarlock | 42 rowing shell |

DESCRIPTION OF THE PREFERRED EMBODIMENTS

As employed herein, the term "rowing shells" refers to sweep boats, sculling boats, canoes, and any other rowing boats for which it would be convenient to adjust the height of the oarlocks regardless of how they are attached to the boat.

The present oarlock adjuster consists of an adjusting tube 10 with its integral flange 11. It is machined or molded from any suitable material. The adjusting tube 10 is smooth inside to pivot on an oarlock pin 16 and threaded externally to engage threaded inserts 24, an oarlock securing bracket 14, or a threaded oarlock 34. Oarlocks 26 and pins 16 are available from various manufacturers and are not unique to this invention. The oarlock pin 16 is attached to a rigger sill 28 in the usual way by setting it through a bored hole in the sill and securing it with a pin bottom nut 30.

Most oarlocks are designed to incorporate bushings or inserts 24 (to adjust for pitch and pin diameter). These inserts are threaded to fit the threads 36 on the adjusting tube 10. The adjusting tube is longer than the oarlock 26 is high. The inserts 24 are positioned at the ends of the oarlock 26 and this assembly is threaded onto the adjusting tube 10, followed by a locknut 12 washer 22 and then the adjusting tube/oarlock unit are slipped onto the oarlock pin 16 and topped with a washer 22, the topstay 20 (if so fitted ), and a pin top nut 18 to secure the assembly. The adjusting tube will be of proper length so that it is free to pivot on the oarlock pin without excessive vertical play. In the drawings, the adjusting tube flange 11 is shown under the oarlock, but assembling it over the oarlock will work well, especially if the rigging includes a topstay 20.

An oarlock securing bracket 14 is designed for use with oarlocks 40 without inserts. It is made of any suitable material. A c-shaped bracket with threaded holes 38 at each end, it fits along the oarlock 40, its holes aligning with the holes for the oarlock pin at each end of the oarlock. With the securing bracket in place, the oarlock/bracket assembly is threaded onto the adjusting tube 10 and assembly proceeds as above.

As an alternative, an oarlock 34 may be bored out and threaded to fit directly onto the adjusting tube without the use of inserts or securing brackets.

Operation

Once installed, oarlock height adjustments may be made manually, quickly, and easily, even on the water. To make an adjustment, the rower reaches out from the shell 42 to the oarlock height adjusting tube 10, loosens the locknut 12, turns adjusting tube 10 by its flange 11 to raise or lower the oarlock 26, then retightens the locknut and resumes rowing. Use of the locknut is not necessary. It may be left loose if multiple height adjustments are anticipated, creating an even simpler procedure.

Whereas particular embodiments of the present invention have been described herein for purposes of illustration, it will be appreciated by those skilled in the art that numerous variations of the details may be made without departing from the invention as described in the appended claims.

What is claimed is:

1. An oarlock height adjuster for a rowing shell comprising:

an oarlock;

an oarlock pin;

an externally threaded adjusting tube with a rigidly attached flange as the lower end of the adjusting tube the oarlock being raised and lowered by manually rotating the flange which rotates the adjusting tube to allow adjustment of oarlock height with the shell in or out of the water;

said adjusting tube able to pivot freely on the oarlock pin;

a lock nut to prevent said adjusting tube from moving; and a c-shaped bracket having threaded holes in each end mounted on the tube.

2. An oarlock height adjuster as in claim 1 with said c-shaped bracket replaced by internally threaded inserts attached in the ends of said oarlock.

3. An oarlock height adjuster as in claim 1 with said c-shaped bracket removed, and said oarlock having internal threads.

* * * * *